US006068497A

United States Patent [19]

Kodama

[11] Patent Number: 6,068,497

[45] Date of Patent: May 30, 2000

[54] CONNECTOR MUTUALLY-FITTING MECHANISM

[75] Inventor: Shinji Kodama, Shizuoka, Japan

[73] Assignee: Yazaki Corporation, Tokyo, Japan

[21] Appl. No.: 08/916,329

[22] Filed: Aug. 22, 1997

[30] Foreign Application Priority Data

Aug. 23, 1996 [JP] Japan ..... 8-222176

[51] Int. Cl.[7] ..... H01R 13/62

[52] U.S. Cl. ..... 439/157; 439/152

[58] Field of Search ..... 439/157, 549, 439/152–156, 158–160, 259, 347, 310

[56] References Cited

U.S. PATENT DOCUMENTS

| | | | |
|---|---|---|---|
| 5,263,871 | 11/1993 | Sano | 439/157 |
| 5,326,274 | 7/1994 | Pfaff et al. | 439/157 |
| 5,575,676 | 11/1996 | Tsukakoshi et al. | 439/157 |
| 5,618,194 | 4/1997 | Maue et al. | 439/157 |
| 5,618,195 | 4/1997 | Cappe | 439/157 |
| 5,641,296 | 6/1997 | Larabell et al. | 1/1 |
| 5,823,807 | 10/1998 | Yamasaki et al. | 439/157 |
| 5,899,762 | 5/1999 | Ainceri | 439/157 |
| 5,947,756 | 9/1999 | Kodama | 439/157 |
| 5,957,707 | 9/1999 | Kodama | 439/157 |

FOREIGN PATENT DOCUMENTS 6-243928 9/1994 Japan .

*Primary Examiner*—Paula Bradley
*Assistant Examiner*—Tho D. Ta
*Attorney, Agent, or Firm*—Morgan, Lewis & Bockius LLP

[57] ABSTRACT

A connector mutually-fitting mechanism in which a pair of connectors, mounted respectively on separate structural members, are fitted together through a fitting lever. Specifically, one connector is projectably and retractably mounted on an instrument panel, and the other connector is fixedly mounted on a gauge board. A driven pin is formed on and projects from the one connector, and a guide groove for receiving the driven pin is formed in the other connector. After the gauge board is connected to the instrument panel, a fitting lever having a cam groove is inserted, thereby fitting the driven pin into the cam groove, and the fitting lever is moved forward and backward, thereby fitting the two connectors together and disengaging the two connectors from each other.

8 Claims, 4 Drawing Sheets

CONNECTOR MUTUALLY-FITTING MECHANISM

BACKGROUND OF THE INVENTION

1. Field of the Invention

This invention relates to a connector mutually-fitting mechanism in which a pair of connectors (used mainly in electric wiring in an automobile), mounted respectively on separate structural members, are fitted together through a fitting lever.

2. Description of the Related Art

One example of connectors for connecting a wire harness, used in electric wiring in an automobile, includes a lever connecting-type connector (disclosed in Japanese Patent Unexamined Publication No. Hei. 6-243928) shown in FIG. 5, in which a pair of connectors a and b are fitted together and disengaged from each other by pivotally moving a lever c. In such a lever connecting-type connector, the connectors a and b are fitted together by pivotally moving the lever c, and therefore there are advantages that the fitting force is reduced and that the positioning for fitting purposes is easy.

However, as shown in FIG. 6, when the lever connecting-type connectors a and b are used so as to connect a wire harness e in an instrument panel d of the automobile to electric wiring in a gauge board f to be mounted on the instrument panel d, the connector b, connected to an end of the wire harness e, is drawn from the instrument panel d, and then is fitted into the connector a mounted on the gauge board f. Then the gauge board f is mounted on the instrument panel d.

Therefore, the wire harness e must have an excess length so that the wire harness-can be pulled to extend exteriorly of the instrument panel d to permit the connecting operation, which results in a disadvantage in that the cost of the member, as well as the weight, is inevitably increased. Besides, when mounting the gauge board f on the instrument panel d, there is a possibility that the wire harness e is caught or held between the instrument panel d and the gauge board f, and in such a case this mounting operation can not be carried out, and also the wire harness e may be damaged. Therefore, means must be provided for preventing such biting, and meticulous attention must be paid when effecting the mounting operation, which leads to a problem that the productivity is lowered.

SUMMARY OF THE INVENTION

In view of the above problems, it is an object of this invention to provide a connector mutually-fitting mechanism in which connectors, mounted in advance respectively on structural members, can be fitted together easily by operating a lever without the need for providing an excess length of a wire harness for connector connecting purposes.

In order to achieve the above object, the invention provides a connector mutually-fitting mechanism comprising: two structural members to be connected together; two connectors to be fitted together, one of the connectors being projectably and retractably mounted on one of the structural members, a driven pin being formed on and projecting from a housing of the one connector, and the other of the connectors being fixedly secured to the other of the structural members; and a fitting lever having a cam groove, the fitting lever being inserted into a space between the two structural members, thereby fitting the driven pin into the cam groove, after the two structural members are connected together, wherein the fitting lever is moved forward and backward, thereby fitting the two connectors together and disengaging the two connectors from each other.

DETAILED DESCRIPTION OF THE PREFERRED EMBODIMENT

A preferred embodiment of the present invention will now be described.

Figure 1:
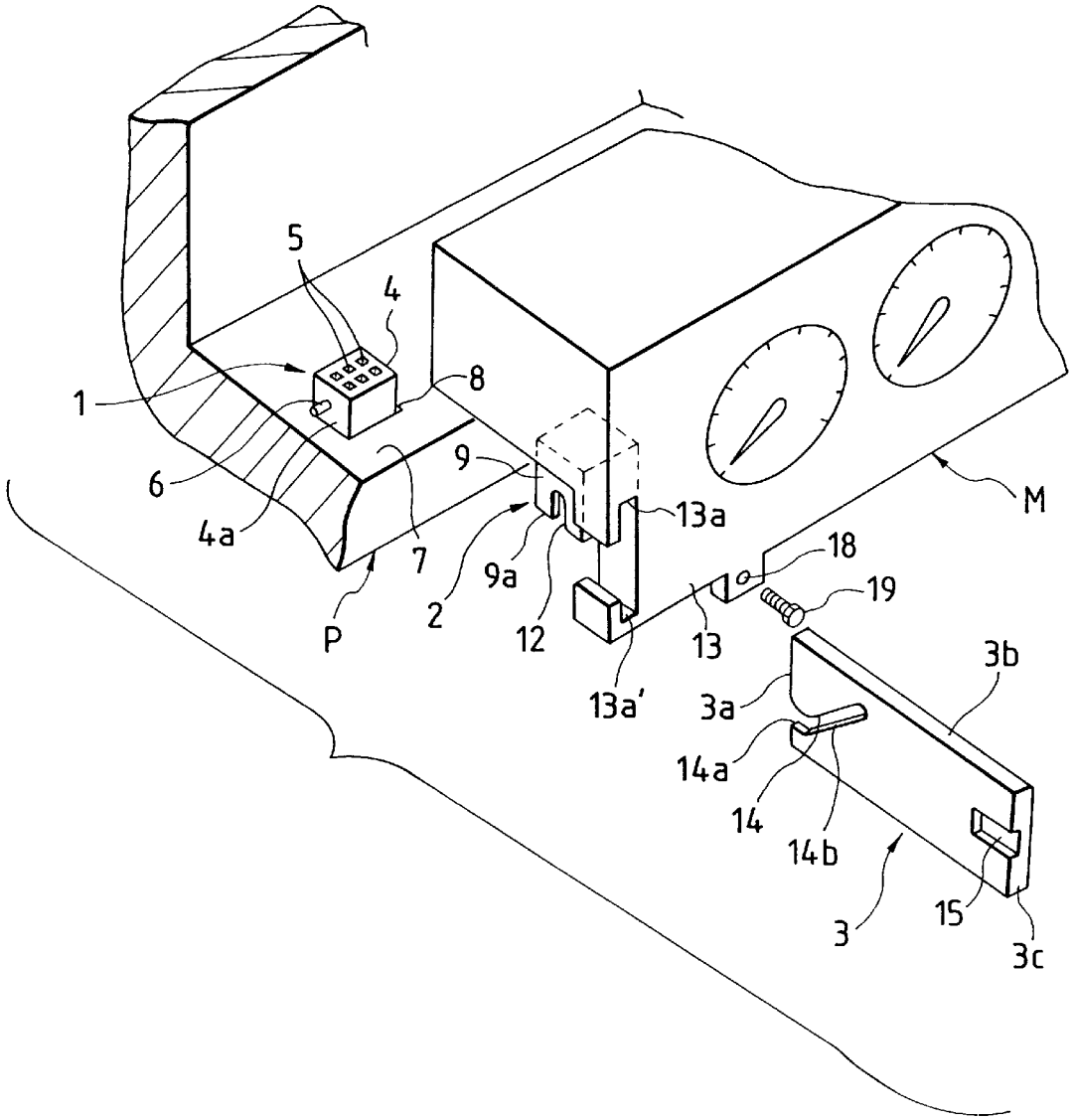
FIG. 1 is a perspective view showing a preferred embodiment of a connector mutually-fitting mechanism of the present invention applied to an instrument panel and a gauge board.

FIG. 1 is a perspective view showing a connector fitting mechanism of the invention applied to an instrument panel (structural member) P of an automobile and a gauge board (structural member) M to be connected to the instrument panel P.

The connector fitting mechanism of this embodiment comprises a male connector 1 projectably and retractably mounted on the instrument panel P, a female connector 2 fixedly mounted on the gauge board M, and a fitting lever 3 operable for fitting the two connectors 1 and 2 together.

The male connector 1 includes a housing 4 which is molded of a synthetic resin, and has a box-shape of a square cross-section, and the housing 4 has a plurality of terminal receiving chambers 5 formed therein. Although not shown, female metal terminals are mounted respectively in the terminal receiving chambers 5. A driven pin 6 is formed on and projects from an outer surface 4*a* of the housing 4. The male connector 1 is projectably and retractably mounted in a receiving hole 8 formed substantially vertically in a lower wall 7 of the instrument panel P.

Figure 2:
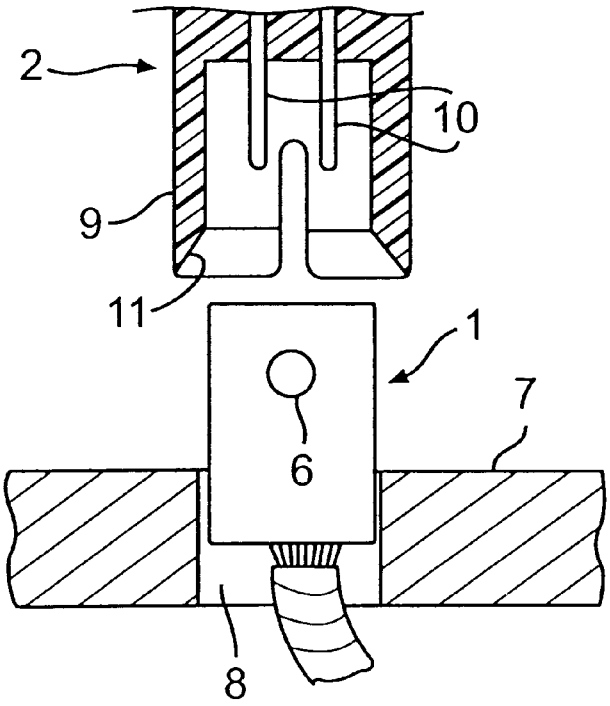
FIG. 2 is a cross-sectional view showing the positions of male and female connectors of FIG. 1 with respect to each other.

The female connector 2 is molded of a synthetic resin, and has a reception portion 9 of a square cross-section for receiving the housing 4 of the male connector 1, and a plurality of male metal terminals 10 project into the reception portion 9, as shown in FIG. 2. A tapering surface 11 is formed on an end or edge of the reception portion 9 so as to facilitate the insertion of the housing 4 of the male connector 1 into the reception portion 9.

A guide groove 12 for receiving the driven pin 6 on the housing 4 of the male connector 1 is formed through a side wall 9*a* of the reception portion 9. The female connector 2 is fixedly secured to an inner side of a front wall 13 of the gauge board, with the reception portion 9 directed toward the male connector 1.

Figure 3:
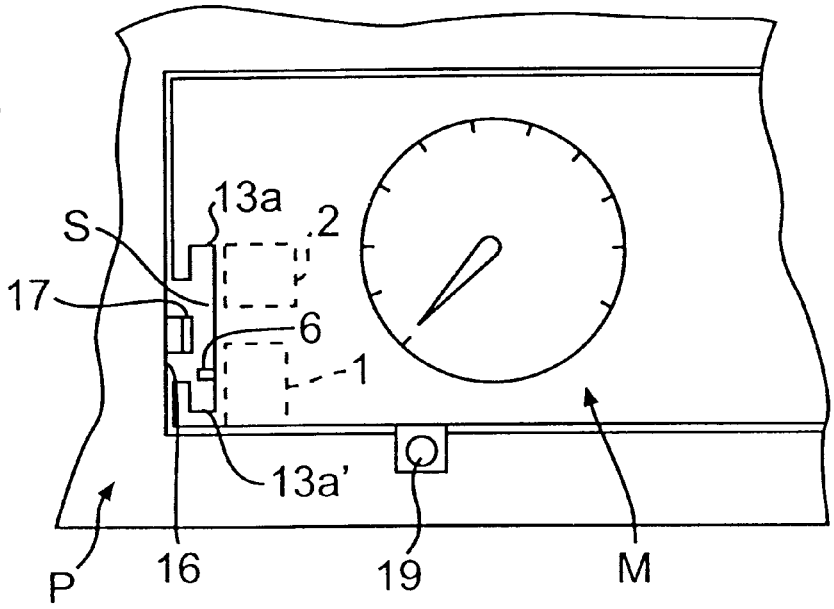
FIG. 3 is a front-elevational view, showing the instrument panel and the gauge board of FIG. 1 connected together.

The fitting lever 3 is in the form of a flat plate, and has a cam groove 14 for receiving the driven pin 6. The cam groove 14 has an introductory port 14*a* provided at one end 3*a* of the fitting lever 3, and a slanting portion 14*b* extending upwardly from the introductory port 14*a* toward an upper edge 3*b* of the fitting lever 3. A retaining recess 15 is formed at the other end 3*c* of the fitting lever 3, and extends toward a central portion thereof. The retaining recess 15 can be fitted on an elastic projection 17 (see FIG. 3), formed on a side wall 16 of the instrument panel P, to retain the fitting lever 3.

A process of fitting the two connectors 1 and 2 by the use of the fitting lever 3 will now be described.

First, each of bolts 19 is passed through a corresponding attachment hole 18 in the gauge board M, and the gauge board M is fastened to the instrument panel P by these bolts 19. Then, the fitting lever 3 is inserted into guide grooves 13*a* and 13*a*' formed in one end of the front wall 13 of the gauge board M, and is advanced into a gap S (see FIG. 3) between the instrument panel P and the gauge board M.

Figure 4:
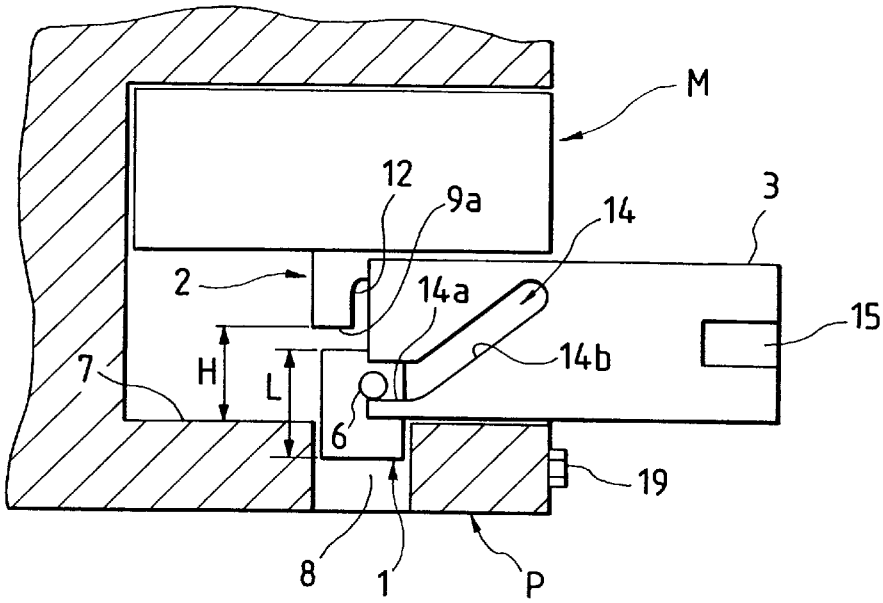
FIG. 4 is a view showing a process of fitting the male and female connectors of FIG. 1 together by a fitting lever.
Figure 5:
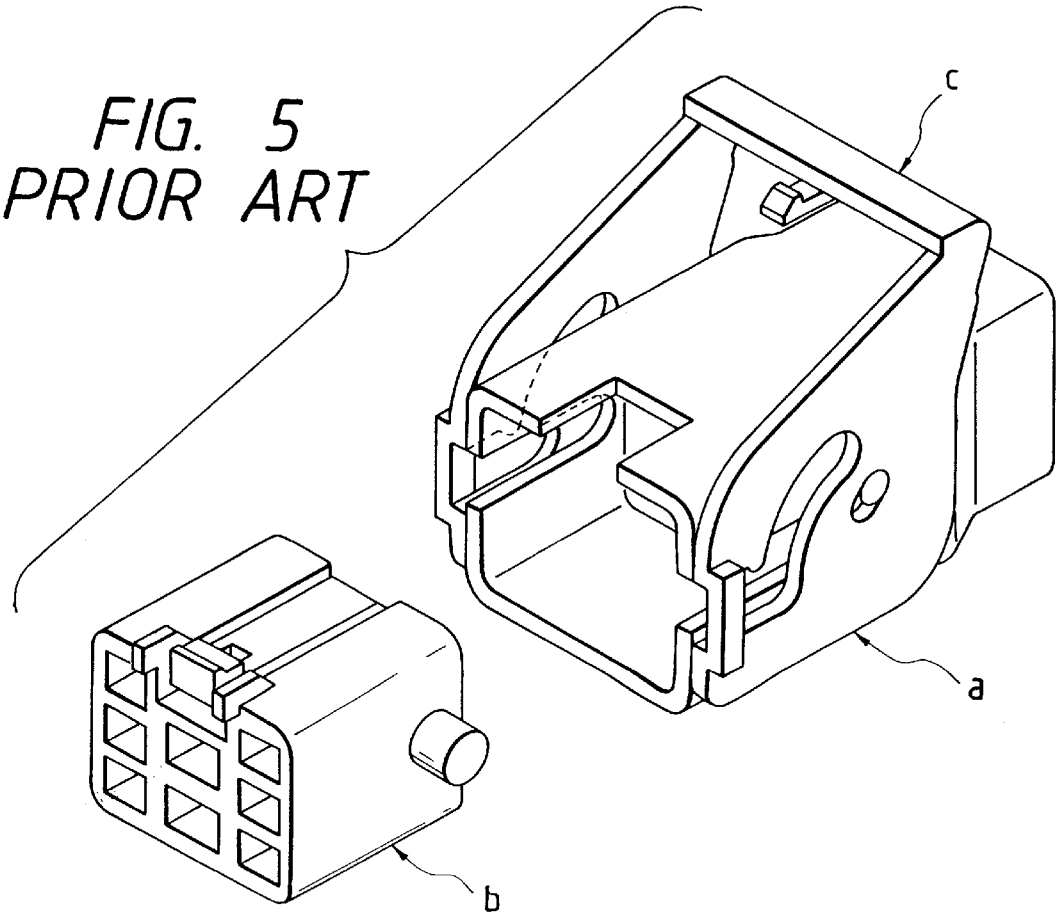
FIG. 5 PRIOR ART
FIG. 5 is a perspective view of a conventional lever connecting-type connector.
Figure 6:
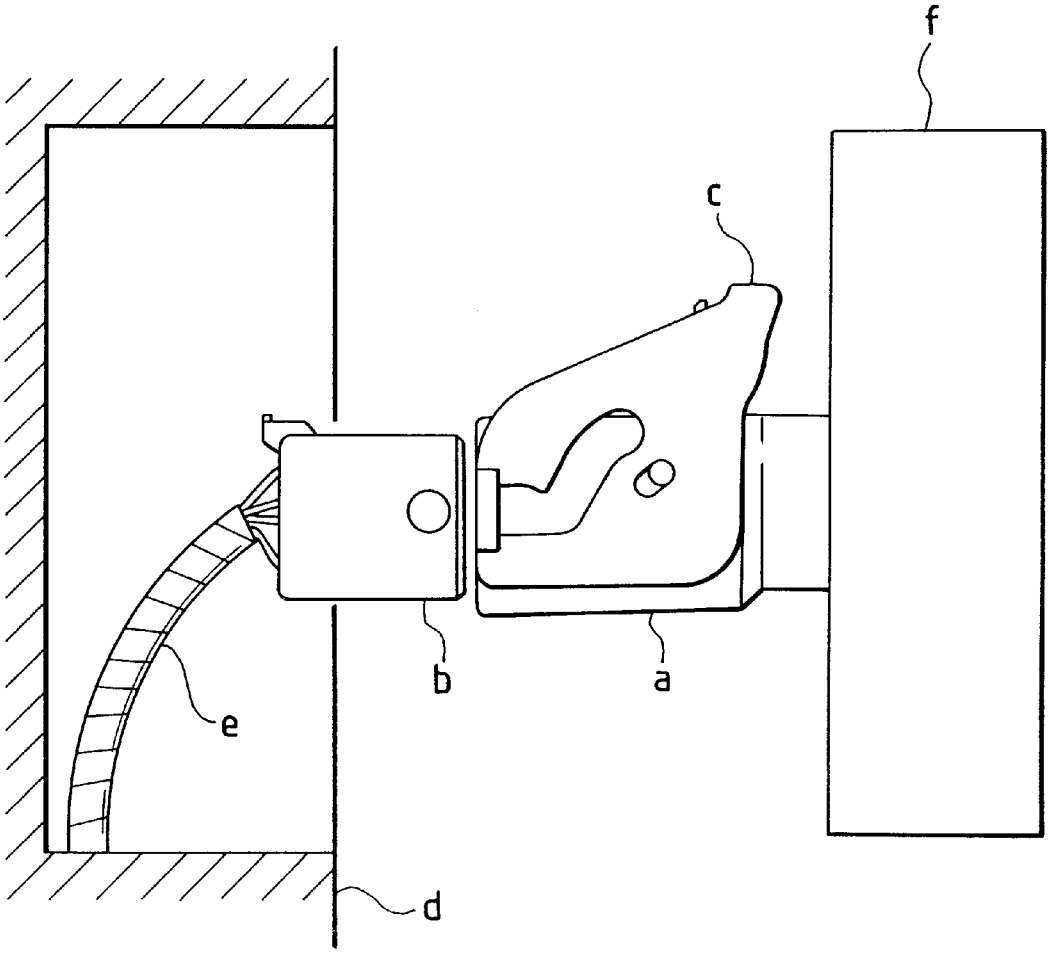
FIG. 6 PRIOR ART
FIG. 6 is a view showing the lever connecting-type connector of FIG. 5 applied to an instrument panel and a gauge board.

When the fitting lever 3 is inserted into the gap S, the driven pin 6 of the male connector 1 is introduced into the introductory port 14*a* of the cam groove 14 in the fitting lever 3, as shown in FIG. 4. When the fitting lever 3 is further inserted, the driven pin 6 moves along the slanting portion 14*b* of the cam groove 14, so that the male connector 1 moves upward toward the male connector 2, and is fitted into the reception portion 9 of the female connector 2. Finally, the two connectors 1 and 2 are fitted together, and the male metal terminals 10 of the female connector 2 are connected respectively to the female metal terminals of the male connector 1.

The distance H between the lower wall 7 of the instrument panel P and the end 9*a* of the reception portion 9 of the female connector 2 is set to be smaller than the length L of the housing 4 of the male connector 1, and therefore the male connector 1 will not be tilted during the time when the male connector 1 is moved upward by the fitting lever 3.

For disengaging the two connectors 1 and 2 from each other, the fitting lever 3 is drawn or pulled, so that the driven pin 6 of the male connector 1 moves along the cam groove 14 of the fitting lever 3 in a manner reverse to the above operation, and therefore the male connector 1 can be easily disengaged from the reception portion 9 of the female connector 2.

In the present invention, the two connectors are mounted respectively on the two structural members to be connected together, and in this condition the fitting lever is operated so as to fit the two connectors together. Therefore, the operation, in which the wire harness is pulled to be extended outwardly when fitting the two connectors together, is omitted, and the wire harness does not need to have an excess length, and therefore the member can be saved, and besides an accident during the connecting operation, that is, damage to the wire harness, is prevented. Furthermore, since the two connectors can be fitted together by operating the fitting lever, the productivity with respect to the connecting operation is greatly enhanced.

What is claimed is:

1. A connector mechanism comprising:

first and second structural members to be connected together;

first and second connectors to be fitted together, said first connector being projectably and retractably mounted on said first structural member, a driven pin being formed on and projecting from a housing of said first connector, and said second connector being fixedly secured to said second structural member; and a fitting lever having a cam groove, said fitting lever being inserted into a space between said structural members, thereby fitting said driven pin into said cam groove, after said structural members are connected together, wherein said cam groove has an introductory port formed in one end of said fitting lever and a slanting portion extending from said introductory port, said fitting lever has a retaining recess formed in the other end thereof, an elastic projection for fitting in said retaining recess is formed on said first structural member, said fitting lever is moved forward and backward, thereby fitting said connectors together and disengaging said connectors from each other, wherein said second connector has a reception portion for receiving said first connector and a guide groove for receiving said driven pin of said first connector is formed in said reception portion.

2. The connector mechanism according to claim 1, wherein said cam groove extends through said lever.

3. A connector mechanism for fitting and disengaging connectors comprising:

a first connector projectably and retractably mounted on a first structural member, said first connector having a pin formed thereon;

a second connector fixedly secured to a second structural member said second connector having a reception portion for receiving said first connector and defining a guide groove for receiving said pin; and a single, flat plate lever having first and second ends and defining a cam groove, said lever being inserted into a space between said structural members, thereby fitting said pin into said cam groove after said structural members are connected together, wherein said lever is moved forward and backward to fit said connectors together and disengage said connectors from each other, said lever defines a retaining recess formed at said second end of said lever, and said first structural member has a projection formed thereon for engaging said retaining recess.

4. The connector mechanism according to claim 3, wherein said cam groove includes an introductory port formed in said first end of the lever.

5. The connector mechanism according to claim 3, wherein said cam groove extends through said lever.

6. A connector mechanism for fitting and disengaging connectors comprising:

a first connector projectably and retractably mounted on a first structural member, said first connector having a single pin formed thereon;

a second connector fixedly secured to a second structural member, said second connector having a reception portion for receiving said first connector and defining a guide groove for receiving said pin; and a lever having first and second ends and defining a single cam groove, said lever being inserted into a space between said structural members, thereby fitting said single pin into said single cam groove after said structural members are connected together, wherein said lever is moved forward and backward to fit said connectors together and disengage said connectors from each other, and said lever defines a retaining recess formed at the second end of the lever and said first structural member has a projection thereon for engaging said retaining recess.

7. The connector mechanism according to claim 6, wherein said cam groove includes an introductory port formed in said first end of the lever.

8. The connector mechanism according to claim 6, wherein said cam groove extends through said lever.

* * * * *